US008251758B2

(12) United States Patent
Yoshida

(10) Patent No.: US 8,251,758 B2
(45) Date of Patent: Aug. 28, 2012

(54) ELECTRICAL CONTACT

(75) Inventor: Munenobu Yoshida, Kanagawa (JP)

(73) Assignee: Kyocera Elco Corporation (JP)

( * ) Notice: Subject to any disclaimer, the term of this patent is extended or adjusted under 35 U.S.C. 154(b) by 95 days.

(21) Appl. No.: 12/839,007

(22) Filed: Jul. 19, 2010

(65) Prior Publication Data

US 2011/0021089 A1 Jan. 27, 2011

(30) Foreign Application Priority Data

Jul. 23, 2009 (JP) ..... 2009-171848

(51) Int. Cl.
*H01R 13/02* (2006.01)

(52) U.S. Cl. ..... 439/884; 439/290

(58) Field of Classification Search ..... 439/884–885, 439/877, 290

See application file for complete search history.

(56) References Cited

U.S. PATENT DOCUMENTS

| | | | | |
|---|---|---|---|---|
| 3,609,650 | A * | 9/1971 | Stokes | 439/636 |
| 4,278,313 | A * | 7/1981 | Blakesley | 439/290 |
| 5,664,974 | A * | 9/1997 | Endo et al. | 439/884 |
| 5,989,080 | A * | 11/1999 | Tsuji et al. | 439/884 |

FOREIGN PATENT DOCUMENTS

| | | |
|---|---|---|
| JP | 43-01346 | 1/1943 |
| JP | 43-23187 | 10/1943 |
| JP | 44-10995 | 5/1969 |
| JP | 44-26025 | 11/1969 |
| JP | 45-27138 | 9/1970 |
| JP | 51-149587 | 12/1976 |
| JP | 073922 | 3/1995 |
| JP | 2000-21485 | 1/2000 |
| JP | 2005-294220 | 10/2005 |

* cited by examiner

*Primary Examiner* — Truc Nguyen

(74) *Attorney, Agent, or Firm* — McCormick, Paulding & Huber LLP

(57) ABSTRACT

An electrical contact having a conductor connecting portion and a contact portion at each end, respectively, includes contact leaves arranged side by side and connected together at common edges thereof via a resilient connecting portion; engaging grooves formed on the contact leaves, respectively, and extending toward the conductor connecting portion from a front end thereof; and a pair of beveled contact surfaces respectively formed on side edges of a pair of opposed inner surfaces of each engaging groove. The pair of beveled contact surfaces come into surface contact with a corresponding pair of beveled contact surfaces of the mating electrical contact when the engaging grooves of the electrical contact are engaged with corresponding engaging grooves of the mating electrical contact upon the electrical contact being connected to the mating electrical contact.

8 Claims, 8 Drawing Sheets

ELECTRICAL CONTACT

CROSS REFERENCE TO RELATED APPLICATION

The present invention is related to and claims priority of the following co-pending application, namely, Japanese Patent Application No. 2009-171848 filed on Jul. 23, 2009.

BACKGROUND OF THE INVENTION

1. Field of the Invention

The present invention relates to an electrical contact (crimp contact/solderless terminal), one end of which is connected to a terminal of an electrical wire and the other end of which is connected to a mating electrical contact connected to another electrical wire.

2. Description of the Prior Art

A conventional technique of making a pair of electrical contacts (crimp contacts/solderless terminals) out of metal plate so that one end of each electrical contact connects to a terminal of an electrical wire and the other end thereof constitutes a contact portion, and connecting the contact portions of the pair of electrical contacts to each other is disclosed in, e.g., FIG. 10 of Japanese Unexamined Patent Publication No. 2000-21485.

Each of the pair of electrical contacts is provided at one and the other ends thereof with a swageable wire fixing portion and a bifurcated first conduction contact portion having a slit, respectively. The wire fixing portion is a portion to be connected to a terminal of an electrical wire by being resiliently deformed via pressure contact. On the other hand, the first conduction contact portion is a portion to be connected to the first conduction contact portion of the other (mating) electrical contact with an angular displacement of 90 degrees about the axis of the electrical wire relative to the first conduction contact portion of the mating electrical contact, and the first conduction contact portions of the pair of electrical contacts are electrically connected to each other with the slits thereof being engaged with each other.

Upon passing a large electrical current through the pair of electrical contacts having the above described structure, since it is necessary to reduce both the contact resistance and the conductor resistance, it is desirable for the contact area between the first conduction contact portions and the cross-sectional area of each first conduction contact portion to be made as large as possible by increasing the thickness of the metal plate that is used for the material of the pair of electrical contacts.

However, if the thickness of the metal plate is increased, the thickness of the wire fixing portion increases accordingly, which makes it difficult to perform a wire connecting operation for fixedly connecting an end (exposed end) of an electrical wire to the wire fixing portion by crimping or swaging the wire fixing portion.

Moreover, in the electrical contact disclosed in the above-mentioned Japanese Unexamined Patent Publication No. 2000-21485, when a twist occurs between the pair of electrical contacts, the contact state between the first conduction contact portions becomes unstable, which may deteriorate the contact reliability therebetween.

SUMMARY OF THE INVENTION

The present invention provides an electrical contact which can achieve a reduction in both contact resistance and electrical resistance, while allowing the aforementioned wire connecting operation to be performed easily, and which makes it possible to maintain contact reliability between a pair of electrical contacts even if a twist occurs therebetween.

According to an aspect of the present invention, an electrical contact is provided, having a conductor connecting portion and a contact portion at one and the other ends of the electrical contact, respectively, the conductor connecting portion being connected to a conductor, and the contact portion being connected to a mating electrical contact, wherein the contact portion includes a plurality of contact leaves which are arranged side by side, each adjacent two of the contact leaves being connected together at common edges thereof via a resilient connecting portion; a plurality of engaging grooves formed on the plurality of contact leaves, respectively, each of the plurality of engaging grooves extending toward the conductor connecting portion from a front end of each the of plurality of contact leaves, respectively; and a pair of beveled contact surfaces which are respectively formed on side edges of a pair of opposed inner surfaces of each of the plurality of engaging grooves, each of the pair of beveled contact surfaces being angled relative to a direction of thickness of each of the plurality of contact leaves, wherein the pair of beveled contact surfaces come into surface contact with a corresponding pair of beveled contact surfaces of the mating electrical contact when the electrical contact is connected to the mating electrical contact. The conductor connecting portion is formed from a single metal plate.

It is desirable for the plurality of contact leaves to be a pair of contact leaves.

Accordingly, even when the electrical contact is twisted relative to the mating electrical contact, a surface contact state between each beveled contact surface of the electrical contact and the associated beveled contact surface of the mating electrical contact that are in surface contact with each other is maintained by relative parallel movement (sliding movement) between the pair of contact leaves by resilient deformation of the contact portion, and hence, the contact reliability between the beveled contact surfaces which are in contact with each other is further improved.

It is desirable for the conductor to include an electrical wire, and for the conductor connecting portion to include a pair of swageable connecting lugs which are connected to an end of the electrical wire.

It is desirable for the pair of beveled contact surfaces to be each angled at an approximately 45 degrees relative to the direction of thickness of each of the plurality of contact leaves.

In an embodiment, a connector is provided, having the above-described electrical contact, wherein the connector includes an insulator having an accommodation hole in which the electrical contact is accommodated.

It is desirable for the connector to include a holding portion, formed in the accommodation hole, for holding the electrical contact in the accommodation hole, and for the accommodation hole of the insulator to be shaped to allow the contact portion to slightly move within the accommodation hole upon the electrical contact being connected to the connector.

Accordingly, since the electrical contact can move in the accommodation hole of the insulator and also since the electrical contact and the mating electrical contact are mutually engaged while being aligned with each other when the contact portions of the electrical contact and the mating electrical contact which face each other are engaged with each other, the contact portions of the electrical contact and the mating electrical contact can also be prevented from being deformed (e.g., from buckling), due to conflicting with each other and misalignment during engagement (engagement with misalignment between the axes of the contact portions of the electrical contact and the mating electrical contact) upon coming into contact with each other.

It is desirable for the mating electrical contact to be identical in shape and size to the electrical contact.

It is desirable for each of the plurality of contact leaves to be bifurcated to have a pair of prongs between which associated one of the plurality of engaging grooves is formed.

The rigidity of the contact portion of the electrical contact according to the present invention is increased by configuring the contact portion from a plurality of contact leaves, and accordingly, one electrical contact and the mating electrical contact are only relatively twisted (rotated) a little amount even if a twisting force is exerted on either of these two electrical contacts that are engaged with each other. In addition, since each contact leaf is displaceable in a manner to maintain the contact state between the contact portions of one electrical contact and the mating electrical contact that are engaged with each other, the contact reliability between the contact portions of these two electrical contacts is maintained.

In addition, the thickness (plate thickness) of the entire contact portion of each electrical contact can be made large. Accordingly, the contact resistance and electrical resistance of the contact portion can be reduced, which makes it possible to achieve a electrical contact suitable for the case where a large electrical current is passed through an electrical wire and the electrical contact therebetween.

Moreover, since the conductor connecting portion is formed from a single metal plate, the conductor connecting portion can easily be molded into a shape required for connection to the conductor, and the operation (e.g., swaging or crimping operation) for connecting the conductor connecting portion to the electrical wire can be easily performed, a lowering of the electrical resistance and an improvement in workability that are mutually contradictory in prior art can both be achieved.

Additionally, even when one of the two connectors connected to each other is carelessly pulled out from the other, e.g., forced to be pulled out from the other improperly in a slanting direction, the contact portion can be prevented from being plastically deformed because the contact portion can move in the accommodation hole.

BRIEF DESCRIPTION OF THE DRAWINGS

The present invention will be discussed below in detail with reference to the accompanying drawings, in which.

DESCRIPTION OF THE EMBODIMENT

An embodiment of an electrical contact according to the present invention will be hereinafter discussed with reference to the accompanying drawings.

Figure 1:
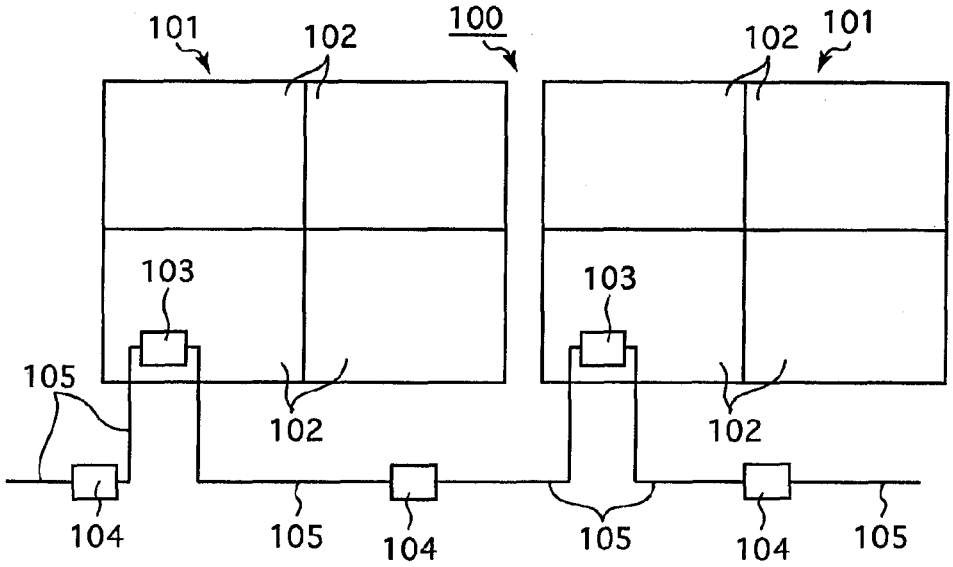
FIG. 1 is a conceptual diaphragm of a photovoltaic power generation system constructed using electrical contacts (connectors) in an embodiment according to the present invention and electrical wires.

FIG. 1 shows a photovoltaic power generation system 100. The photovoltaic power generation system 100 is configured from a plurality (large number) of panel units 101 which are mutually electrically connected (only two panel units 101 are shown in FIG. 1). The photovoltaic power generation system 100 is installed outdoors (e.g., on top of a building). Each panel unit 101 includes four solar cell panels 102 (which are mutually electrically connected), and one of the four solar cell panels 102 is provided with a joint box 103. The joint boxes 103 of the plurality of panel units 101 and a plurality (large number) of other joint boxes 104 (provided at locations away from the plurality of panel units 101) are mutually connected via electrical wires 105 and connectors 10 (not shown in FIG. 1) provided at terminals of the electrical wires 105 so that power generated by each panel unit 101 is supplied to an electrical or electronic equipment (not shown).

The structure of each connector 10 will be discussed hereinafter. Each connector 10 is provided with an insulator 15 and two contacts (electrical contacts/crimp contacts) 30, which are genderless contacts that are identical in shape.

Figure 8:
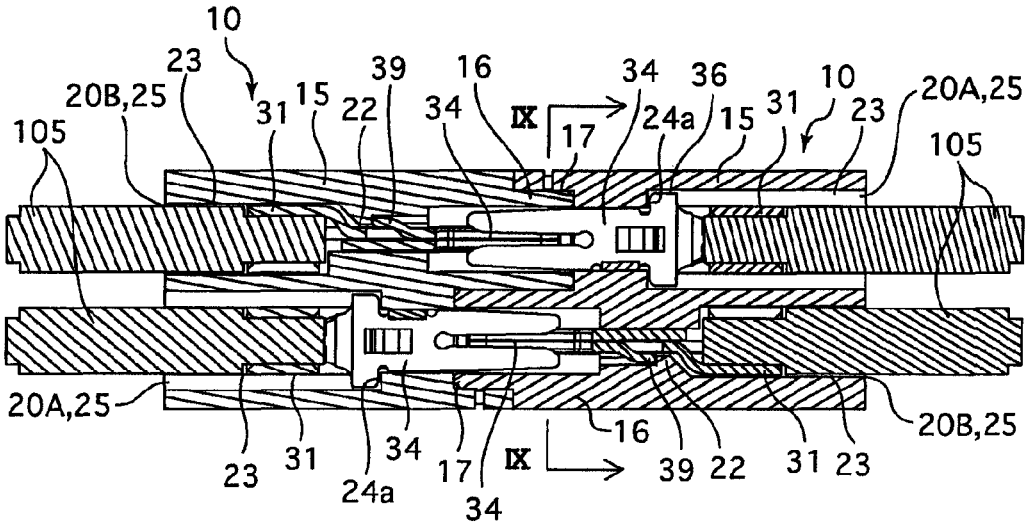
FIG. 8 is a cross sectional view taken along the VIII-VIII line shown in FIG. 7, viewed in the direction of the appended arrows.
Figure 9:
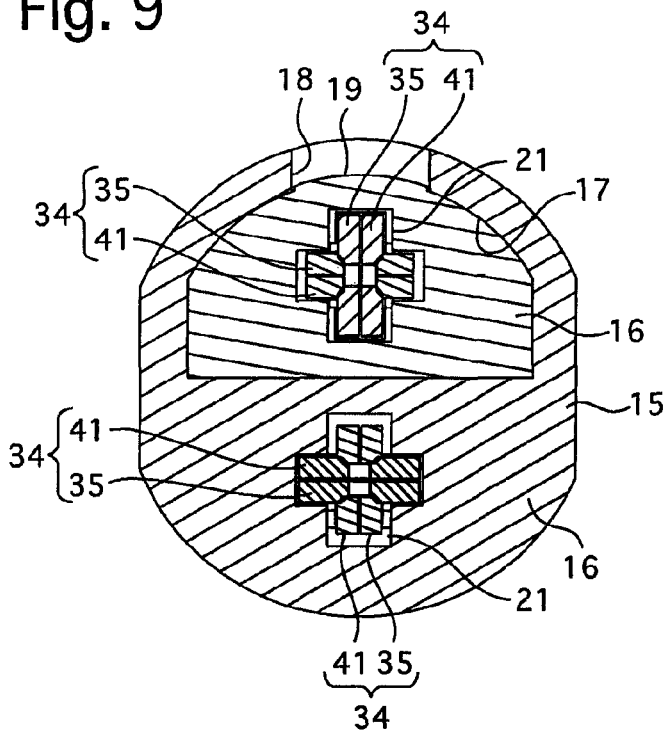
FIG. 9 is a cross sectional view taken along the IX-IX line shown in FIG. 8, viewed in the direction of the appended arrows.

The insulator 15 is molded out of an insulating synthetic resin by injection molding. The insulator 15 is provided at one end thereof with an engaging protrusion 16 having a substantially semicircular shape in cross section and an engaging recess 17 having the same cross sectional shape as the engaging protrusion 16. The engaging protrusion 16 and the engaging recess 17 are formed so that one of the engaging protrusion 16 and the engaging recess 17 is positioned on top of the other (see FIG. 6). The insulator 15 is provided with a lock slot 18 which is formed as a through-hole that extends from the engaging recess 17 through to an upper surface of the insulator 15. The engaging protrusion 16 is provided on an outer peripheral surface thereof with a rib-shaped engaging projection 19 which disengageably engages with the lock slot 18 of another (mating) insulator 15. The insulator 15 is provided with a pair of accommodation holes 20A and 20B which are formed as through-holes elongated in the lengthwise direction (horizontal direction with respect to FIG. 8) of the insulator 15. The pair of accommodation holes 20A and 20B are formed so that one of the pair of accommodation holes 20A and 20B is positioned on top of the other. Portions of the accommodation holes 20A and 20B on the engaging protrusion 16 and the engaging recess 17, respectively, are each formed as a contact accommodation portion 21 that are substantially cross-shaped in cross-section (see FIG. 9). Other portions of the accommodation holes 20A and 20B on the opposite sides thereof from the engaging protrusion 16 and the engaging recess 17, respectively, are each formed as a wire accommodation portion 25 having a cylindrical portion 23 and a pair of projection guide grooves 24. The two contact accommodation portions 21 and the two wire accommodation portions 25 are aligned in the lengthwise direction of the insulator 15 and are communicatively connected to each other inside the insulator 15, respectively. In addition, the insulator 15 is provided, at an end of an inner surface of each contact accommodation portion 21 and toward the associated accommodation portion 25, with a retaining projection 22 which projects radially inwards (see FIG. 8).

The structure of each contact 30 will be discussed in detail hereinafter.

Each contact 30 is an integrally-formed product which is formed by stamping a metal plate having a uniform thickness (plate thickness t=0.8 mm) and thereafter bending the metal plate. The metal plate is a conductive material made of a resilient copper alloy (e.g., phosphor bronze, beryllium copper or titanium copper) or a resilient Corson-copper alloy, and is coated firstly with a base plating of nickel (Ni) plating and subsequently with a finish plating of gold (Au) plating.

Each contact 30 is provided with a wire connecting portion (conductor connecting portion) 31 and a contact portion 34.

Figure 2:
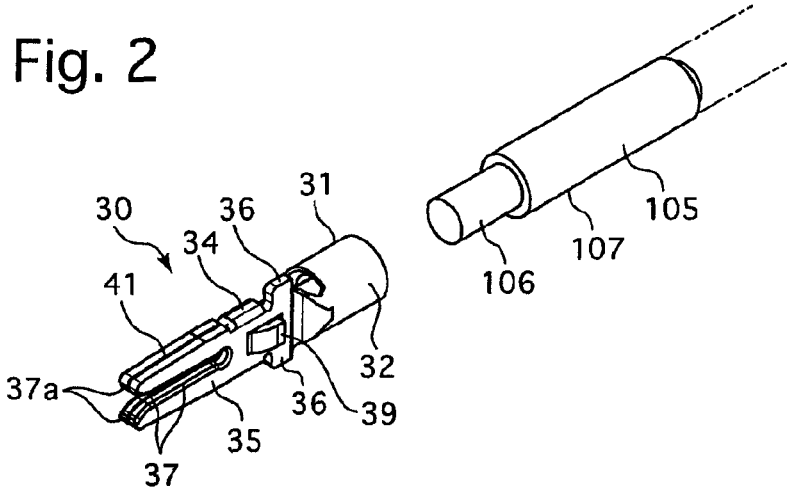
FIG. 2 is a perspective view of an electrical contact and an associated electrical wire in a separated state.
Figure 3:
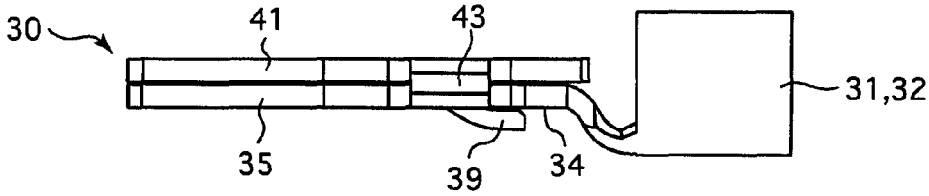
FIG. 3 is a bottom view of the electrical contact.
Figure 4:
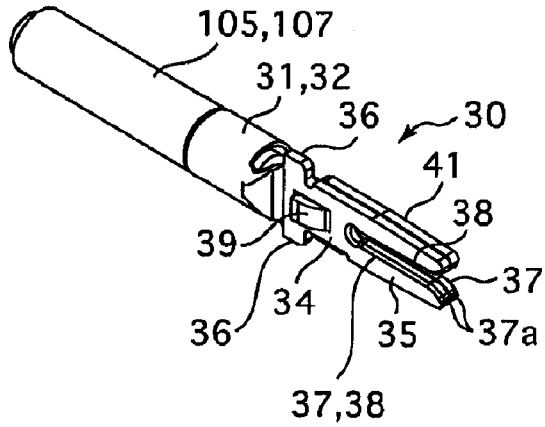
FIG. 4 is a perspective view of the electrical contact and the electrical wire in a connection completed state.

The wire connecting portion 31 is provided with a pair of swageable connecting lugs 32, each having a semicircular shape in cross section. The pair of swageable connecting lugs 32 are integrated at the base ends (fixed ends) thereof. The wire connecting portion 31 is formed into the shape of a substantially hollow cylinder (tube) in a state before an electrical wire 105 is connected to the wire connecting portion 31 (see FIG. 2).

Figure 12:
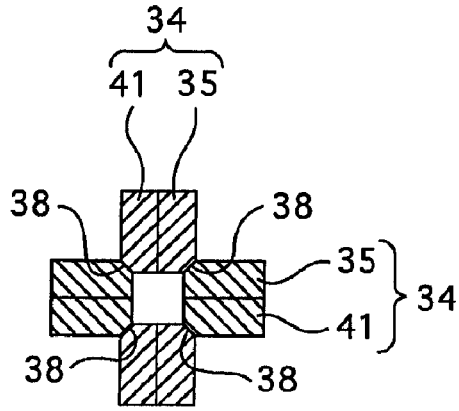
FIG. 12 is a cross sectional view taken along the XII-XII line shown in FIG. 11, viewed in the direction of the appended arrows.
Figure 13A:
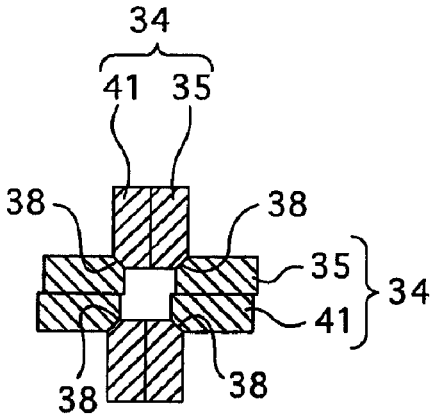
FIG. 13A is a view corresponding to that of FIG. 12, showing a state where a twisting force is exerted on the pair of electrical contacts.
Figure 13B:
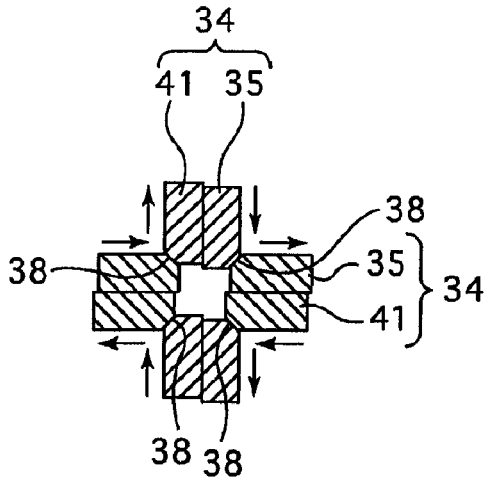
FIG. 13B is a view corresponding to that of FIG. 12, showing a state where a twisting force greater than that in the case shown in FIG. 13A is exerted on the pair of electrical contacts.

The contact portion 34 extends from the base ends of the pair of swageable connecting lugs 32. The contact portion 34 is provided with a first contact leaf (bifurcated leaf) 35, a second contact leaf (bifurcated leaf) 41 and a resilient connecting portion 43. The first contact leaf 35 is continuously formed with the base ends of the pair of swageable connecting lugs 32. The second contact leaf 41 is positioned next to the first contact leaf 35 so that the first contact leaf 35 and the second contact leaf 41 are positioned side by side. The first contact leaf 35 and the second contact leaf 41 are connected to each other via the resilient connecting portion 43. A slight gap exists between the first contact leaf 35 and the second contact leaf 41 of each contact 30 when it is in a free state (i.e., before the contact 30 is engaged with the mating contact 30). The first contact leaf 35 is provided, at the base end thereof (an end thereof on the base end of each swageable connecting lug 32) on opposite sides of the base end of the first contact leaf 35, with a pair of guide projections 36 which project in opposite directions away from each other along a direction substantially orthogonal to the lengthwise direction of the contact 30. Each contact 30 is further provided at the front of the first contact leaf 35 with an engaging groove (slit) 37 which extends toward the base end of the first contact leaf 35. As shown in FIGS. 12, 13A and 13B, etc., a pair of opposed inner surfaces of the engaging groove 37 of the first contact leaf 35 are flat surfaces that are parallel to each other, and the outer edges of the pair of opposed inner surfaces are beveled, constituting a pair of beveled contact surfaces 38, respectively, each of which is angled at approximately 45 degrees relative to both the parallel flat surfaces of the engaging groove 37 and the direction of the thickness of the first contact leaf 35. In addition, the first contact leaf 35 is provided with a retaining projection 39 which projects in a direction away from the second contact leaf 41. The retaining projection 39 is formed by cutting and raising part of the first contact leaf 35.

The second contact leaf 41 of each contact 30 is substantially identical in shape to the first contact leaf 35 and parallel to the first contact leaf 35. The second contact leaf 41 of each contact 30 is provided with an engaging groove (slit) 37 and a pair of beveled contact surfaces 38 which are identical in shape to those formed on the first contact leaf 35.

Figure 11:
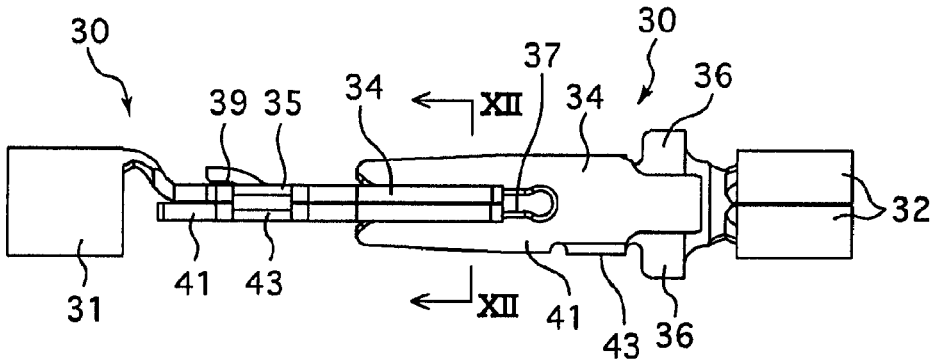
FIG. 11 is a side elevational view of the pair of electrical contacts in a connected state.

The resilient connecting portion 43 connects adjacent edges at one side (adjacent edges at the lower side with respect to the right contact 30 shown in FIG. 11) of the first contact leaf 35 and the second contact leaf 41. The resilient connecting portion 43 is smaller in width (in the horizontal direction with respect to FIG. 11) than each of the first contact leaf 35 and the second contact leaf 41, thus being resiliently more easily deformable than either the first contact leaf 35 or the second contact leaf 41.

Each electrical wire 105 includes a core wire (stranded wire/conductor) 106 made of a large number of conductive strands (metal strands) bundled together, and an insulating sheath 107 made of an insulating material which sheathes the core wire 106; the core wire 106 is exposed at both ends of the electrical wire 105. Each electrical wire 105 is connected at one end thereof to one joint box 103, and electrical current generated by the associated solar cell panel 102 is passed through the electrical wire 105 (core wire 106) via the end thereof that is connected to the joint box 103.

On the other hand, the wire connecting portion 31 of one contact 30 is connected to the other end (end of the core wire 106) of the electrical wire 105 that is connected to one joint box 104. More specifically, after an exposed end of the core wire 106 has been inserted into the wire connecting portion 31, the pair of swageable connecting lugs 32 are swaged (plastically deformed) radially inwards using a swaging tool to thereby swage (press-join) the pair of swageable connecting lugs 32 against the exposed end of the core wire 106, thereby retaining the exposed end of the core wire 106. Since the thickness of the metal plate by which each contact 30 is formed is small, the pair of swageable connecting lugs 32 can be easily swaged.

Figure 5:
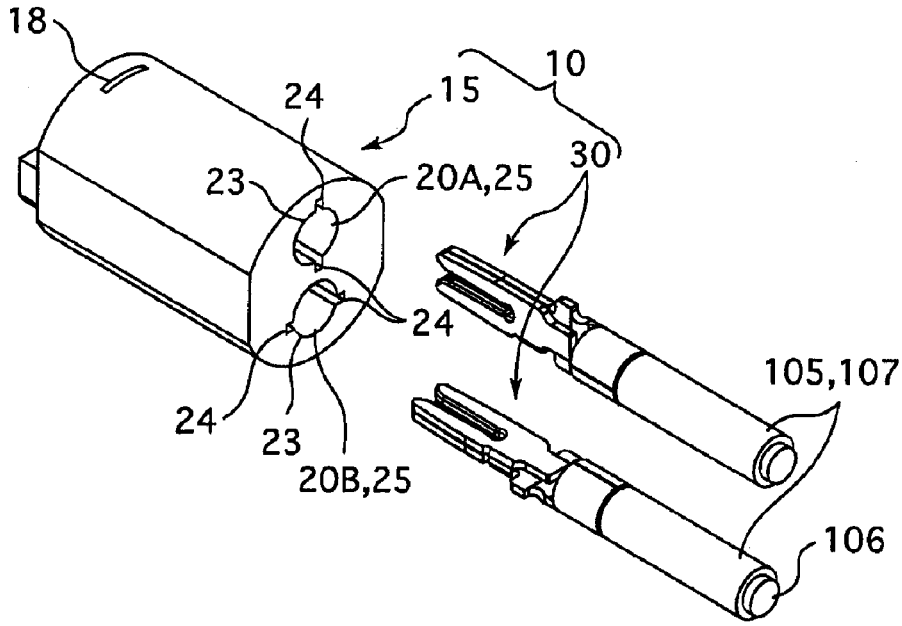
FIG. 5 is a perspective view of an insulator and two combinations of an electrical contact and an electrical wire in a separated state.

Two contacts 30 which have been fixed to common ends of two electrical wires 105 are inserted into the pair of accommodation holes 20A and 20B of the insulator 15 of one connector 10, respectively, with the insertion angles of the two contacts 30 being relatively displaced by an angle of 90 degrees about the axes thereof relative to the pair of accommodation holes 20A and 20B (see FIG. 5). Thereupon, the pair of guide projections 36 of each contact 30 are engaged in the pair of projection guide grooves 24 of the associated wire accommodation portion 25, so that the two contacts 30 pass through the two wire accommodation portions 25 to be engaged in the two contact accommodation portions 21, respectively, while the ends of the insulating sheaths 107 adjacent to the exposed ends of the core wires 106 are positioned in the cylindrical portions 23 of the accommodation holes 20A and 20B, respectively (see FIGS. 8 and 9). Thereupon, the pair of guide projections 36 of each contact 30 come into contact with the inner ends (holding portion) 24*a* of the pair of projection guide grooves 24 of the associated accommodation hole 20A or 20B, respectively, so that the engagement of the inner ends 24*a* with the pair of guide projections 36 prevents each contact from being further inserted into the associated accommodation hole 20A or 20B. Furthermore, the retaining projection 39 of each contact 30 comes into engagement with the retaining projection 22 in the associated accommodation hole 20A or 20B, so that the engagement of the retaining projection 39 of each contact 30 with the associated retaining projection 22 prevents each contact 30 from coming out of the associated accommodation hole 20A or 20B. However, a very small tolerance (gap) is provided between each retaining projection 22 and the corresponding retaining projection 39, and hence, each contact 30 is held in the associated accommodation hole 20A or 20B without being immovably fixed to the insulator 15 but to allow a slight (minute) relative movement therebetween to occur.

Figure 6:
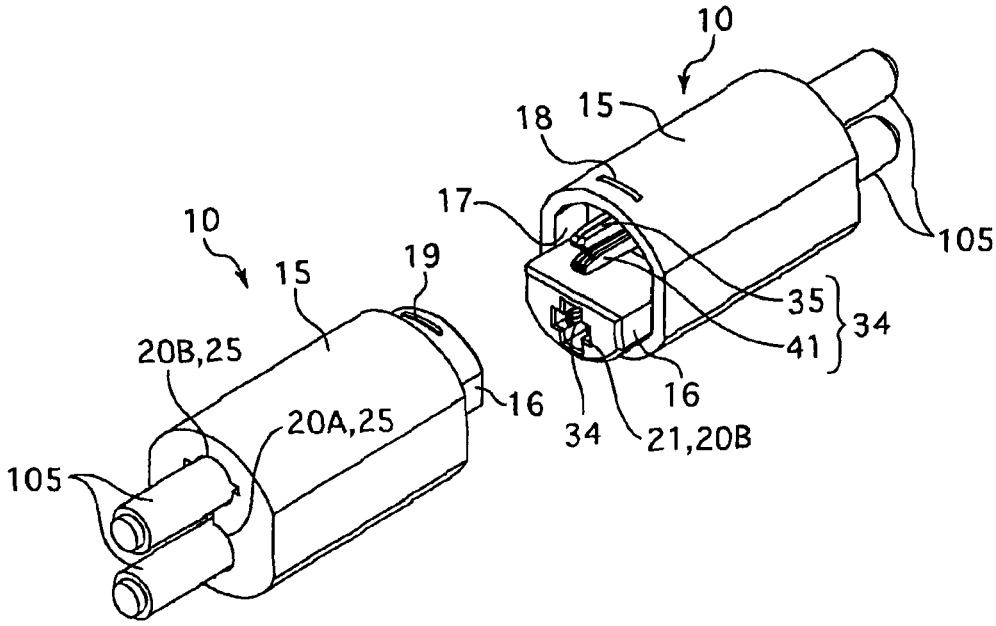
FIG. 6 is a perspective view of a pair of connectors, which are connectable with each other, in a disconnected state.

As shown in FIG. 6, part of the contact portion 34 of the contact 30 inserted into the accommodation hole 20A passes through an end of the accommodation hole 20A (the wire accommodation portion 25) to be positioned in the engaging recess 17, and the contact portion 34 of the contact 30 inserted into the accommodation hole 20B is positioned in the contact accommodation portion 21 of the accommodation hole 20B.

Integrating two contacts 30 with one insulator 15 in such a manner completes one connector 10.

Figure 7:
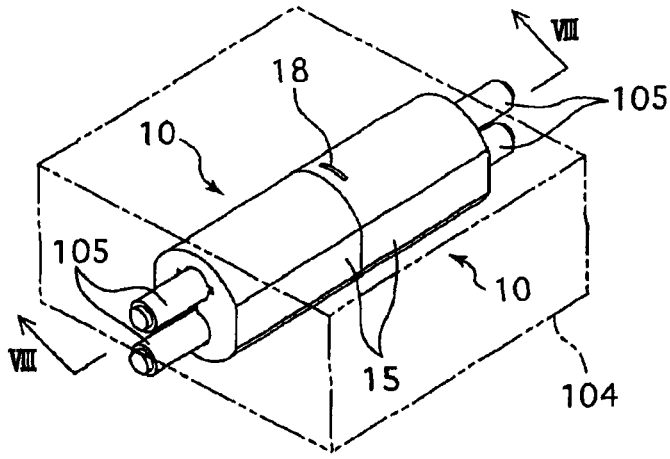
FIG. 7 is a perspective view of the pair of connectors shown in FIG. 6 in a connected state.

Each connector 10, to which two electrical wires 105 are fixed at the exposed ends thereof, is connected to another connector (mating connector) 10 in one joint box 104. More specifically, as shown in FIG. 6, one connector 10 that is provided at common ends of two electrical wires 105 and another connector 10 that is provided at common ends of another two electrical wires 105 are inserted into the opposite ends of a connecting through-hole (not shown) formed in one joint box 104 therethrough, respectively, with the insertion angles of the two connectors 10 being relatively displaced at an angle of 180 degrees about the axes thereof relative to the connecting through-hole, to bring the engaging protrusion 16 and the engaging recess 17 of the insulator 15 of one connector 10 into engagement with the engaging recess 17 and the engaging protrusion of the insulator 15 of the other connector 10, respectively; and to bring the lock slot 18 and the engaging projection 19 of the insulator 15 of the one connector 10 into engagement with the engaging projection 19 and the lock slot 18 of the insulator 15 of the other connector 10, respectively (see FIGS. 7, 8 and 9).

Figure 10:
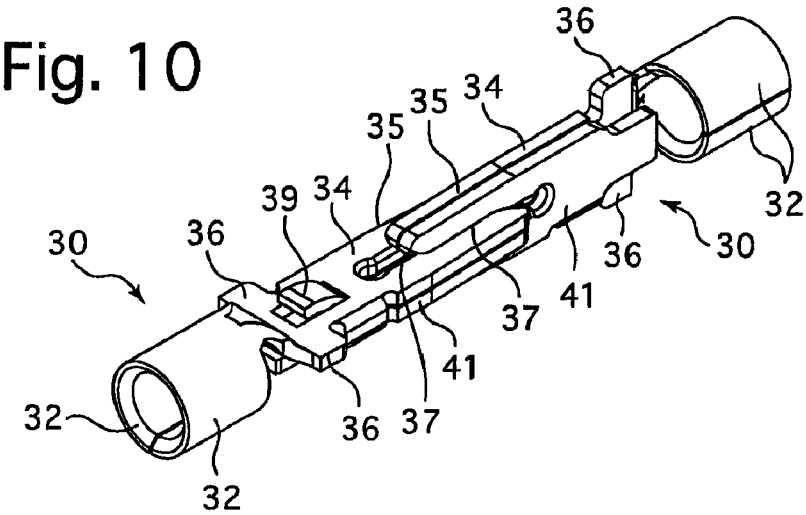
FIG. 10 is a perspective view of a pair of electrical contacts in a connected state.

Thereupon, the pair of engaging grooves 37 (the engaging grooves 37 of the first contact leaf 35 and the second contact leaf 41) of the contact 30 inserted into the accommodation hole 20A of one of the two contacts 30 are engaged with the pair of engaging grooves 37 (the engaging grooves 37 of the first contact leaf 35 and the second contact leaf 41) of the contact 30 inserted into the accommodation hole 20B of the other contact 30, while the pair of engaging grooves 37 (the engaging grooves 37 of the first contact leaf 35 and the second contact leaf 41) of the contact 30 inserted into the accommodation hole 20A of the other contact 30 are engaged with the pair of engaging grooves 37 (the engaging grooves 37 of the first contact leaf 35 and the second contact leaf 41) of the contact 30 inserted into the accommodation hole 20B of the one contact 30. At this time, leading surfaces 37*a* formed as beveled surfaces at the front ends (free ends) of the engaging grooves 37 of each contact 30 first come in contact with those of the mating contact 30, and accordingly, the contact portions 34 (engaging grooves 37) of the one and the other contacts 30 are engaged with each other while maintaining (while limiting) the diametrically opposed positions thereof (see FIG. 12) in a manner so that it is difficult for the opposed contact portions 34 to impose load on each other (i.e., so as to be suitable for engagement). As a result, as shown in FIGS. 10 through 12, the surfaces (inner surfaces) of the first contact leaf 35 and the second contact leaf 41 of each contact 30 which are opposed to each other come in surface contact with each other (a gap exits therebetween before the contact 30 is engaged with the mating contact 30), and the four beveled contact surfaces 38 of the one contact 30 and the four beveled contact surfaces 38 of the other (mating) contact 30 come into mutual surface contact, respectively, which total ly prevents air, water, dust and the like from entering in between each two beveled contact surfaces 38 that are in mutual surface contact.

Accordingly, an electrical current generated by the solar cell panels 102 is passed through the two contacts 30 (the contact portions 34 thereof) which are in contact with each other to be supplied to electrical or electronic equipment (not shown). In addition, the contact portion 34 of each contact 30 is high in rigidity and small in resilient deformation volume, so that the engaging force between each two of the beveled contact surfaces 38 which come in surface contact with each other is high when the two contacts 30 are engaged with each other, and accordingly, the contacting state between the two contacts 30 is maintained unless the two connectors 10 are intentionally disengaged from each other.

In this manner, in the present embodiment of the electrical contact, by configuring the contact portion 34 of each contact 30 with the first contact leaf 35 and the second contact leaf 41, the cross sectional area of the contact portion 34 and the contact area between the two contacts 30 which are in contact with each other increase, so that the contact resistance and the electrical resistance are small; hence, a large electrical current can be smoothly passed through the two contacts 30 therebetween.

Moreover, since only the contact portion 34 of each contact 30 is configured of the first contact leaf 35 and the second contact leaf 41 that are overlaid on each other (since the wire connecting portion 31 is of a single-plate structure), the operation connecting an electrical wire 105 to the wire connecting portion 31 can be easy performed, while the overall rigidity of the contact portion 34 can be increased.

Furthermore, when one contact 30 and the mating contact 30 are engaged with each other, forces are exerted on the first contact leaf 35 and the second contact leaf 41 of each contact 30 in directions to make the first contact leaf 35 and the second contact leaf 41 into intimate contact uniformly with each other due to the inclination of each beveled contact surface 38, so that not only electrical performance between the two contacts 30 that are engaged with each other becomes stable, these two contacts also becomes mechanically stable.

As shown in FIG. 13A, in the case where a large twisting force is exerted on one of two contacts 30 engaged with each other (on the vertically-positioned contact 30 in the case shown in FIG. 13A, the contact portion 34 of which lies in a vertical plane), the first contact leaf 35 and the second contact leaf 41 of the other contact 30 (on the horizontally-positioned contact 30 in the case shown in FIG. 13A, the contact portion 34 of which lies in a horizontal plane) move parallel to each other (relatively slide on each other) horizontally in opposite directions by resilient deformation of the associated resilient connecting portion 43, while the upper prong and the lower prong of the vertically-positioned contact 30 slightlymove horizontally in opposite directions. Accordingly, the contact reliability between the beveled contact surfaces 38 which are in contact with each other is maintained.

In the case where a twisting force greater than that in the case shown in FIG. 13A is exerted on the vertically-positioned contact 30, moving forces in the various directions shown by the arrows in FIG. 13B occur in each first contact leaf 35 and each second contact leaf 41 as shown in FIG. 13B, so that the first contact leaf and the second contact leaf 41 of the vertically-positioned contact 30 also move parallel to each other (relatively slide on each other) vertically in opposite directions. However, since the surface-contacting state between the opposed beveled contact surfaces 38 is maintained, fluctuation in contact resistance is extremely small, and the contact reliability between the beveled contact surfaces 38 which are in contact with each other is maintained.

Additionally, since the first contact leaf 35 and the second contact leaf 41 of each contact 30 are movable relative to each other, a twisting moment (resilient force) acts on the contact portion 34 to move the contact portion from a twisted state to a mechanically-stable diametrically opposed state (see FIG. 12) even if the contact portion 34 twists. Accordingly, the contact portion 34 of each contact 30 has a highly reliable contact structure which can easily recover from twisting and exhibits excellent flexibility characteristics.

Although the present invention has been described based on the above illustrated embodiment, the present invention is not limited solely thereto; various modifications to the above illustrated embodiment of the electrical contact is possible.

For instance, it is possible that the contact portion 34 of each contact 30 be configured from three or more than three contact leaves so that adjacent side edges of each two adjacent contact leaves are connected to each other via a resilient connecting portion.

In addition, it is possible that opposed surfaces of adjacent contact portions (e.g., the first contact portion 35 and the second contact portion 41) be made to contact each other from the beginning (i.e., before two contacts 30 are connected to each other).

In addition, although the wire connecting portion 31 is a so-called closed barrel type, in which the pair of swageable connecting lugs 32 are formed into a hollow cylinder in the above illustrated embodiment of the electrical contact, the wire connecting portion can be a so-called open barrel type, in which the pair of swageable connecting lugs 32 are formed mutually separate from each other.

Additionally, the wire connecting portion 31 can be formed into a shape that allows the wire connecting portion 31 to be soldered to the core wire 106 of the electrical wire 105.

Figure 14:
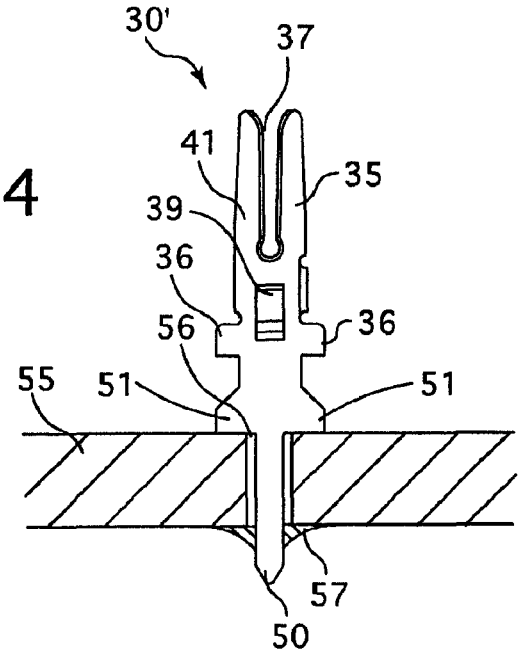
FIG. 14 is a side elevational view of a modified embodiment of the electrical contact and a circuit board (shown in cross section) to which the electrical contact is soldered.
Figure 15:
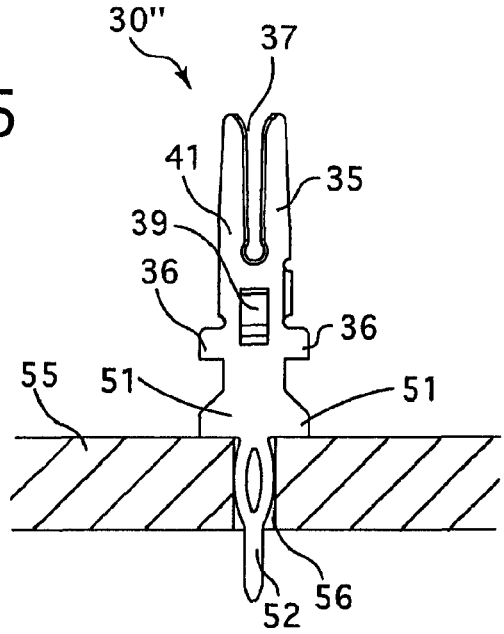
FIG. 15 is a view corresponding to that of FIG. 14, showing another modified embodiment of the electrical contact.

FIGS. 14 and 15 show a contact (electrical contact) 30' and a contact (electrical contact) 30", respectively, each of which has a conductor connecting portion different in structure from the wire connecting portion 31 of the contact 30.

The contact 30' shown in FIG. 14 is provided with a terminal 50 in the shape of a small-diameter pin, and is provided, between the terminal 50 and the pair of guide projections 36, with a pair of contact projections 51. The pair of contact projections 51 are in contact with a surface (upper surface with respect to FIG. 14) of a circuit board 55, and the terminal 50 is inserted into a through-hole 56 formed through the circuit board 55. The end of the terminal 50 is connected by solder 57 to a circuit pattern (not shown) formed on the back of the circuit board 55. The contact 30" shown in FIG. 15 is provided with a press-fit terminal 52. When the contact 30" is mounted to the circuit board 55, the press-fit terminal 52 is press-fitted into the through-hole 56 while resiliently deforming a wide-width portion (resilient bulging portion) of the terminal 52 until the pair of contact projections 51 come in contact with a surface (upper surface with respect to FIG. 15) of the circuit board 55, which brings the wide-width portion of the terminal 50 into contact with a plated portion (which is continuous with the aforementioned circuit pattern on the back of the circuit board 55) formed on the inner surface of the through-hole 56. If the contact 30' or 30" is connected to another (mating) contact 30, 30' or 30", the circuit board 55 is electrically connected to the electrical wire 105 or another circuit board 55.

In addition, it is possible for two connectors 10 to be connected to each other in an exposed state, i.e., without using a joint box 104. In this case, it is possible for the surfaces of the insulators 15 of the two connectors 10 and the associated ends of the electrical wires 105 to be covered with a synthetic resin in a watertight fashion via outsert molding to prevent water from entering the accommodation holes 20A and 20B through gaps between the open ends of the accommodation holes 20A and 20B and the associated ends of the electrical wires 105.

Figure 16:
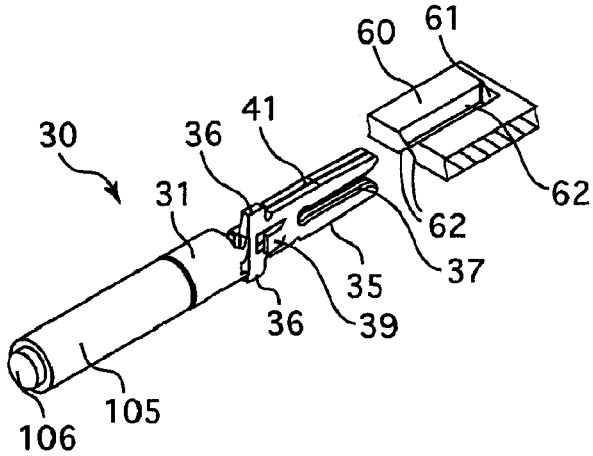
FIG. 16 is a perspective view of another embodiment of the electrical contact and a portion of an associated metal plate contact in a disconnected state.
Figure 17:
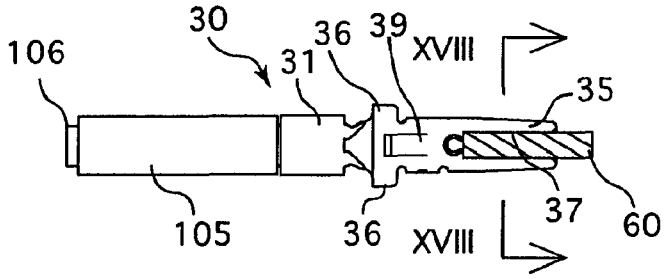
FIG. 17 is a side elevational view of the electrical contact and the portion of the associated metal plate contact (shown in cross section) in a connected state.
Figure 18:
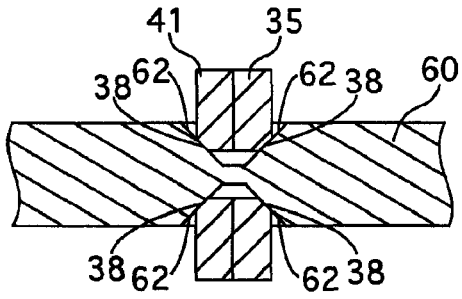
FIG. 18 is a cross sectional view taken along the XVIII-XVIII line shown in FIG. 17.

Additionally, as shown in FIGS. 16 through 18, each contact 30 can be connected to a conductive metal plate contact (conductor) 60 which is electrically connected with a circuit board or the like (not shown).

The metal plate contact 60 is provided on both sides of an edge thereof with a pair of engaging grooves 61, respectively, and is provided on both side edges of each engaging groove 61 with a pair of beveled contact surfaces 62, respectively, each of which is angled at 45 degrees relative to the direction of the plate thickness of the contact 60. Making the engaging groove 37 of the contact 30 engage with the pair of engaging groove 61 causes each beveled contact surface 38 of the contact 30 to be in surface contact with the corresponding beveled contact surface 62 (see FIG. 18). Accordingly, an electrical current can be passed between the electrical wire 105 and the aforementioned circuit board, or the like, via the contact 30 and the metal plate contact 60.

Instead of the pair of engaging grooves 61, an engaging slit which extends through the metal plate contact 60 in the direction of the plate thickness thereof and has beveled contact surfaces 62 on edges of the engaging slit can be formed in the metal plate contact 60 so as to allow the engaging groove 37 of the contact 30 to be engaged with the engaging slit.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. An electrical contact having a conductor connecting portion and a contact portion at one and the other ends of said electrical contact, respectively, said conductor connecting portion being connected to a conductor, and said contact portion being connected to a mating electrical contact, wherein said contact portion comprises:

a plurality of contact leaves which are arranged side by side, each adjacent two of said contact leaves being connected together at common edges thereof via a resilient connecting portion;

a plurality of engaging grooves formed on said plurality of contact leaves, respectively, each of said plurality of engaging grooves extending toward said conductor connecting portion from a front end of each said of plurality of contact leaves, respectively; and a pair of beveled contact surfaces which are respectively formed on side edges of a pair of opposed inner surfaces of each of said plurality of engaging grooves, each of said pair of beveled contact surfaces being angled relative to a direction of thickness of each of said plurality of contact leaves, wherein said pair of beveled contact surfaces come into surface contact with a corresponding pair of beveled contact surfaces of said mating electrical contact when said electrical contact is connected to said mating electrical contact; and wherein said conductor connecting portion is formed from a single metal plate.

2. The electrical contact according to claim 1, wherein said plurality of contact leaves comprise a pair of contact leaves.

3. The electrical contact according to claim 1, wherein said conductor comprises an electrical wire, and wherein said conductor connecting portion comprises a pair of swageable connecting lugs which are connected to an end of said electrical wire.

4. The electrical contact according to claim 1, wherein said pair of beveled contact surfaces are each angled at an approximately 45 degrees relative to said direction of thickness of each of said plurality of contact leaves.

5. A connector having said electrical contact according to claim 1, wherein said connector comprises an insulator having an accommodation hole in which said electrical contact is accommodated.

6. The connector according to claim 5, further comprising a holding portion, formed in said accommodation hole, for holding said electrical contact in said accommodation hole, and wherein said accommodation hole of said insulator is shaped to allow said contact portion to slightly move within said accommodation hole upon said electrical contact being connected to said connector.

7. The electrical contact according to claim 1, wherein said mating electrical contact is identical in shape and size to said electrical contact.

8. The electrical contact according to claim 1, wherein each of said plurality of contact leaves is bifurcated to have a pair of prongs between which associated one of said plurality of engaging grooves is formed.

* * * * *

UNITED STATES PATENT AND TRADEMARK OFFICE

CERTIFICATE OF CORRECTION

PATENT NO. : 8,251,758 B2
APPLICATION NO. : 12/839007
DATED : August 28, 2012
INVENTOR(S) : Munenobu Yoshida It is certified that error appears in the above-identified patent and that said Letters Patent is hereby corrected as shown below:

Assignee:

Patent Title Page, Section (73) please delete the assignee:
"Kyocera Elco Corporation" and insert the correct Assignee --Kyocera Connector Products Corporation--.

Signed and Sealed this
Second Day of April, 2013

Teresa Stanek Rea
*Acting Director of the United States Patent and Trademark Office*